United States Patent [19]

Matranga et al.

[11] Patent Number: 4,907,543

[45] Date of Patent: Mar. 13, 1990

[54] BOILER AIR PORT CLEANER

[76] Inventors: Joseph G. Matranga, 5015 N. Hillwood Cir., Mobile, Ala. 36608; Gary W. Lewis, 308 S. Santos Dr., Mobile, Ala. 36619

[21] Appl. No.: 268,473

[22] Filed: Nov. 7, 1988

[51] Int. Cl.[4] ..... F22B 37/48

[52] U.S. Cl. ..... 122/379; 122/387; 432/75; 15/104.18

[58] Field of Search ..... 122/361, 379, 387; 432/2, 75; 15/104.18, 104.16

[56] References Cited

U.S. PATENT DOCUMENTS

| | | | |
|---|---|---|---|
| 1,251,480 | 1/1918 | Cross | 122/387 |
| 3,667,743 | 6/1972 | Kovalcik et al. | 432/75 |
| 3,875,904 | 4/1975 | Astrom | 122/379 |
| 3,918,375 | 11/1975 | Hayakawa et al. | 432/75 |
| 4,538,552 | 9/1985 | Smuda | 122/387 |
| 4,545,308 | 10/1985 | Zateka | 122/379 |

*Primary Examiner*—Henry C. Yuen

*Attorney, Agent, or Firm*—Fleit, Jacobson, Cohn, Price, Holman & Stern

[57] ABSTRACT

A boiler air port cleaner in the form of a substantially plate-like cutter reciprocated by a piston and cylinder power device and guided by a guide structure mounted on the outer wall of a boiler with the plate-like cutter cleaning slag from air ports in the inner boiler wall.

7 Claims, 1 Drawing Sheet

BOILER AIR PORT CLEANER

BACKGROUND OF THE INVENTION

1. FIELD OF THE INVENTION

The present invention generally relates to a cleaning apparatus utilized in association with a boiler and more particularly a boiler air port cleaner in the form of a substantially plate-like cutter reciprocated by a piston and cylinder power device and guided by a guide structure mounted on the outer wall of a boiler with the plate-like cutter cleaning slag from air ports in the inner boiler wall.

INFORMATION DISCLOSURE STATEMENT

In recovery boilers, the primary fuel used is a liquor which is sprayed inside the boiler by the use of spray guns located above air ports in the recovery boiler. In spraying the liquor into the boiler, it is desirable that it be distributed as equally as possible throughout the interior of the recovery boiler. The liquor begins to solidify as gravity forces it down the inner walls of the boiler and as it gets closer to the air ports of the boiler, the cooler air being forced into the boiler through the air ports reacts with the liquor causing a hard, crusty covering (slag) which restricts and can, in some instances, completely block the air flow through the ports.

While various types of cleaning devices are known for use with boilers to clean various boiler components, the most common method for slag removal from recovery boilers involves the use of a long steel pole or rod to chip slag from the air ports. While there have been some efforts to provide automated systems for this purpose, such systems have had limited usefulness. The following U.S. patents relate to cleaning devices, some of which are specifically adapted for use with boiler components.

| | |
|---|---|
| 568,247 | 1,583,011 |
| 617,335 | 2,104,900 |
| 620,113 | 2,199,109 |
| 1,110,319 | 4,015,304 |
| 1,205,230 | |

SUMMARY OF THE INVENTION

An object of the present invention is to provide a boiler air port cleaner especially adapted for use with recovery boilers having forced air inlet ports in the inner wall thereof on which "slag" becomes deposited and restricts or blocks the air ports with the cleaner including a guided, reciprocated plate-like cutter that is powered by a double acting piston and cylinder power device.

Another object of the invention is to provide a cleaner in accordance with the preceding object in which the plate-like cutter is substantially the same shape and size as the air ports with the periphery of the cutter being slightly spaced inwardly from the inner periphery of the air port to effectively clean slag and other deposits from the air port in the inner wall of a recovery boiler.

A further object of the invention is to provide a boiler air port cleaner in which the cutter is mounted on a reciprocating rod that is guided by a guide structure mounted on the outer wall of the boiler and extending a substantial distance inwardly and outwardly of the outer boiler wall with the double acting piston and cylinder power device being air operated and mounted rigidly to the outer end of the guide structure thereby providing a securely mounted cleaner which can be accurately positioned so that the plate-like cutter can pass completely through the air port in the inner wall of the boiler in a reciprocatory manner for effectively cleaning and removing slag or other solid deposits around the inner periphery of the air port.

Still another object of the invention is to provide a boiler air port cleaner which is simple in construction, effective in cleaning air ports, dependable in operation and easy to install and remove.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
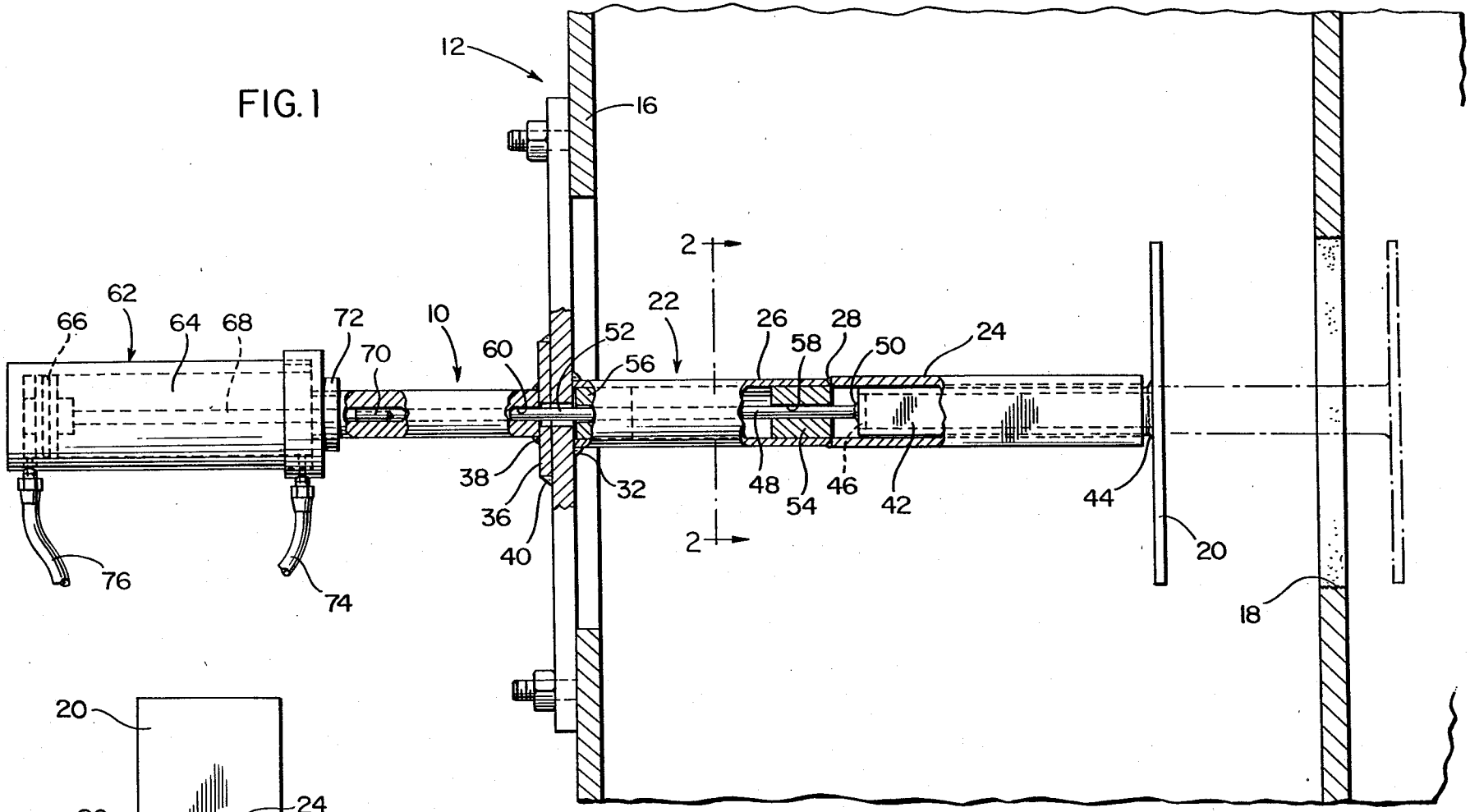
FIG. 1 is a side elevational view of the cleaner of the present invention with portions of the cleaner and boiler walls being shown in section for illustrating the structure and operation of the cleaner.
Figure 2:
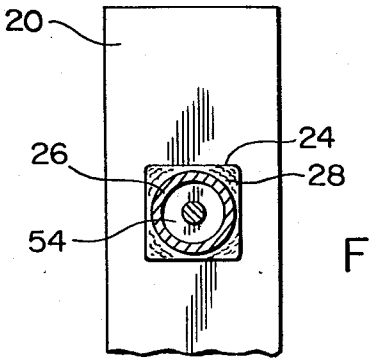
FIG. 2 is a transverse, sectional view taken substantially upon a plane passing along section 2—2 on FIG. 1 illustrating the specific construction of the guide structure for the reciprocating cutter and rod-like structure.

Referring now specifically to the drawings, the boiler air port cleaner of the present invention is generally designated by reference numeral 10 and is associated with a recovery boiler wall structure 12 including an inner wall 14 and an outer wall 16 with the inner wall including ports 18 through which forced air passes and tends to cool and solidify liquor migrating down the inner surface of the inner wall 14 and cause slag to build up on the air port 18 to restrict and in some cases block the air port 18 and prevent inflow of forced air into the interior of the boiler wall 14.

The cleaner 10 includes a substantially flat, rectangular cutter 20 in the form of a metal plate that is shaped and sized to substantially the same size as the air port 18 with the periphery of the cutter 20 being slightly spaced inwardly from the inner periphery of the air port 18 when it passes therethrough as illustrated in FIG. 1 thereby cutting and removing slag and other solid deposits from the interior periphery of the air port 18 when the cutter 20 passes therethrough from the solid line position illustrated in FIG. 1 to the dotted line position illustrated in FIG. 1.

A guide structure 22 is provided for guiding the cutter 20 when it is reciprocated through the air port 18. The guide structure 22 includes an elongated square tubular member 24 and an elongated cylindrical tubular member 26 with the tubular members 24 and 26 being axially aligned and rigidly connected at their abutting ends 28. The cylindrical tubular member is rigidly affixed to the inner surface of a mounting plate 30 by welding 32 or any other rigid fastening arrangement. The plate 30 is mounted on the exterior wall 16 in closed relation to an enlarged opening 32 which is in alignment with the air port 18 with the cylindrical tubular member 26 also extending through the opening 32 as illustrated. A shorter cylindrical tubular member 34 is connected to the exterior surface of the mounting plate 30 in axial alignment with the tubular member 26 with the inner end of the tubular member 34 including a reinforcing plate 36 to which the tubular member 34 is welded as at 38 with the reinforcing plate 36 being welded to the mounting plate 30 with this welded connection being designated by reference numeral 40.

The cutter 20 includes an elongated square guide member 42 rigidly secured centrally to the plate-like cutter 20 by welding 44 or other rigid fastening means. The interior configuration of the tubular member 24 is square and slidingly receives and guides the square member 42 as it reciprocates to support and guide the cutter 20 and prevent angular displacement of the cutter 20 about a central axis, thereby retaining the cutter 20 in proper aligned position with respect to the air port 18. The end of the rigid member 42 which is also tubular is provided with a closure plate 46 and extending therefrom is an elongated guide rod 48 rigidly affixed to the end plate 46 by welding 50 or other rigid fastening means. The guide rod 48 has a circular cross-sectional configuration and extends throughout the length of the tubular member 26 and through openings 52 in the mounting plate 30 and reinforcing plate 36. The tubular member 26 includes a pair of longitudinally spaced support bearings 54 and 56 which include a central longitudinal bore 58 slidably supporting and guiding the rod 48 as it reciprocates. The bore 58 in the bearings 54 and 56 is in axial alignment with the opening or bore 52 through the mounting plate 30 and the reinforcing plate 40 with the bearings being rigidly affixed to the tubular member 26. The tubular member 34 includes an axial bore 60 that slidably receives the rod 48.

A power device generally designated by reference numeral 62 is provided to reciprocate the rod 48 and the member 42 and thus the cutter 20 in relation to the guide structure 22 and in relation to the air port 18 for extending the cutter 20 inwardly through the air port 18 to the dotted line position and returning it to its full line position in a repetitive fashion to clean the air port 18 by removing any slag therefrom. The power device 62 includes a cylinder 64 rigidly mounted on the tubular member 34 with the cylinder including a piston 66 reciprocally mounted therein and a piston rod 68 extending through the end of the cylinder 14 and being connected to the rod 48 at 70 with the cylinder 64 being rigidly fixed to the tubular member 34 in a conventional manner at 72. Air supply and exhaust hoses 74 and 76 are connected to opposite ends of the cylinder 64 and are communicated with a supply of compressed air through a control valve structure of standard construction to alternately admit and exhaust air from the ends of the cylinder to reciprocate the piston 66 in a well-known manner with such control either being manual or automatic. The air cylinder is a double acting cylinder and is a standard, well-known power device and the details of the air cylinder and the control valve and compressed air source are not disclosed since they form no specific part of the present invention inasmuch as they are commercially available products.

The bearings or bushings 54 and 56 may be constructed of well-known materials and these components may be brass bushings. The tubular member 26 forming a housing for the bushings 54 and 56 is preferably constructed of stainless steel round tubing. Likewise, the square tubular member 24 forming an outer guide is constructed of stainless steel square tubing that may be 2"×2". The inner reciprocating guide member 42 is also constructed of stainless steel frame tubing 1-½"×1-½" in which the exterior of the inner guide member 42 is in close fitting relationship to the inner surface of the outer tubular guide 24. The plate forming the cutter 20 is also constructed of stainless steel and the shape and configuration thereof will be custom made to closely fit through air ports 18 which may vary in shape and size in different types of recovery boilers. The mounting plate or flange 30 is rigidly affixed to the outer boiler wall 16 by ½" bolts or any other fastening means that will securely mount the plate or flange in place with the fastening devices being removable to enable the cleaner to be installed and removed in a quick and efficient manner.

With the cleaning tool of the present invention, the air port 18 in the inner wall 14 can be maintained in clean condition so that pressurized air passing between the inner and outer walls 14 and 16 of the recovery boiler can effectively enter through the air ports 18 inasmuch as the total area of each air port will be maintained substantially constant by utilizing the cleaner of the present invention at periodic intervals. When the cleaner is not being used, a closure plate may be secured to the outer wall by using the fastening bolt arrangement employed for securing the mounting plate or flange 30 to the wall.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A boiler air port cleaner comprising a rigid, one-piece plate-like cutter having a periphery corresponding with the periphery of the air port in the boiler and being slightly smaller for reciprocating movement through the air port to remove solidified slag from the periphery of the air port, an elongated actuating member rigidly attached to said cutter, rigid guide means slidably receiving said actuating member for guiding the actuating member during reciprocation and power means connected with the actuating member for rreciprocating the actuating member and cutter, said guide means including a mounting plate adapted to be mounted detachably to an outer wall of a boiler with the cutter in alignment with an adjacent air port in an inner wall of the boiler.

2. The structure as defined in claim 1 wherein said guide means and actuating member include coacting longitudinally extending non-circular components to enable reciprocation of the cutter and preventing angular displacement of the cutter about a longitudinally axis of the actuating member.

3. The structure as defined in claim 2 wherein said guide means includes a longitudinally extending tubular member of cylindrical internal cross-sectional configuration rigidly affixe to said mounting plate, a square tubular member rigidly affixed to the end of said tubular member having a cylindrical internal cross-sectional configuration and in alignment therewith, said actuating member including an elongated square member rigidly affixed to the cutter and slidably received in the square tubular member for relative reciprocation in the square tubular member with the square tubular member and square member affixed to the cutter including a guided reciprocating relationship that will prevent angular displacement of the cutter about the longitudinal axis of the acutating member.

4. The structure as defined in claim 3 wherein said tubular member having a cylindrical external cross-sectional configuration includes a pair of brass bushings spaced longitudinally therein, said actuating member including a rod connected to the square member with the rod being slidably received in the brass bushings for guiding the movement of the rod.

5. The structure as defined in claim 4 wherein said guide means includes a rigid cylindrical guide member mounted on the mounting plate in opposed relation to the tubular guide members and including a central bore receiving the actuating rod with the actuating rod being connected to the power device, said power device being a double acting air pressure operated piston and cylinder connected to the outer end of the guide means and including a piston rod connected to the actuating rod for reciprocating the cutter in relation to the air port.

6. In combination with a recovery boiler including an outer wall and an inner wall in which the inner wall is provided with at least one air port for passage therethrough with the air port being subject to solidification of slag around the inner periphery thereof to restrict or obstruct air flow through the port, a cleaning apparatus for removing slag accumulated on the inner periphery of the air port, said apparatus comprising a rigid, one-piece plate-like cutter having an external periphery substantially the same as but slightly smallere than the internal periphery of the air port, an elongated actuating member rigidly attached to said cutter and extending through an opening in the outer wall of the boiler, rigid guide means slidably receiving said actuating member for reciprocating movement and power means connected to the actuating member and extending outwardly of the outer wall of the boiler to reciprocate the cutter in relation to the air port for removing slag and the like, said guide means including a mounting plate mounted detachably to said outer wall of the boiler.

7. The combination as defined in claim 6 wherein said guide means includes an elongated tubular member rigid with said mounting plate and including a portion having an internal polygonal cross-sectional configuration, said actuating member extending through the tubular member and including a portion with a polygonal external surface to prevent angular displacement of the cutter during reciprocation.

* * * * *